US008419255B2

(12) United States Patent
Wu et al.

(10) Patent No.: US 8,419,255 B2
(45) Date of Patent: Apr. 16, 2013

(54) DISPLAY, BEZEL AND MANUFACTURING METHOD OF BEZEL

(75) Inventors: Chun-Yin Wu, Taipei (TW); Mu-Te Chien, Taipei (TW); Chen-Yi Wang, Taipei (TW); Shi-Kuan Chen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 368 days.

(21) Appl. No.: 12/947,805

(22) Filed: Nov. 16, 2010

(65) Prior Publication Data

US 2011/0267840 A1 Nov. 3, 2011

Related U.S. Application Data

(60) Provisional application No. 61/329,097, filed on Apr. 29, 2010.

(51) Int. Cl.
*F21V 17/10* (2006.01)

(52) U.S. Cl.
USPC ..... 362/611; 362/633

(58) Field of Classification Search ..... 362/611, 362/633, 97.2, 97.3
See application file for complete search history.

(56) References Cited

U.S. PATENT DOCUMENTS

| | | | | |
|---|---|---|---|---|
| 6,773,644 | B1 * | 8/2004 | Eiden | 264/132 |
| 2005/0252758 | A1 * | 11/2005 | Schmidt et al. | 200/310 |
| 2006/0054482 | A1 * | 3/2006 | Radu | 200/308 |
| 2009/0115312 | A1 * | 5/2009 | Hu | 313/498 |

* cited by examiner

*Primary Examiner* — David V Bruce
(74) *Attorney, Agent, or Firm* — Jianq Chyun IP Office

(57) ABSTRACT

A display suitable for a portable electronic device is provided. The display includes a back cover, a bezel and a display panel. The bezel includes a frame and an electroluminescent light (EL) source layer. The frame is assembled to the back cover and has an opening. The electroluminescent light source layer is attached to the frame, wherein the electroluminescent light source layer and the frame are formed by an in-mold forming process and then integrated with the back cover. The display panel is assembled between the back cover and the frame and exposed by the opening.

13 Claims, 6 Drawing Sheets

DISPLAY, BEZEL AND MANUFACTURING METHOD OF BEZEL

CROSS-REFERENCE TO RELATED APPLICATION

This application claims the priority benefit of U.S. provisional application Ser. No. 61/329,097, filed on Apr. 29, 2010. The entirety of the above-mentioned patent application is hereby incorporated by reference herein and made a part of this specification.

BACKGROUND OF THE INVENTION

1. Field of the Invention

The invention generally relates to a display, a bezel, and a manufacturing method of the bezel. More particularly, the invention relates to a display, a bezel, and a manufacturing method of the bezel suitable for a portable electronic device.

2. Description of Related Art

Through the improvements of semi-conductor components and display technology, electronic devices are now being developed to be smaller, multi-functioned, portable, and convenient. Common portable electronic devices include personal digital assistants, mobile phones, and notebook computers. Portable electronic devices can use a foldable method to save area, in order to achieve the objective of compactness.

Using the notebook computer as an example, a common notebook computer is assembled with a main body and a display, wherein the main body and the display are pivoted relatively. The user can shut together the main body and the display of the notebook computer through the relative pivoting between the main body and the display in order to be conveniently portable. When use of the notebook computer is desired, the display can be opened up and operated conveniently. In detail, the display includes a back cover, a bezel and a display panel. The display panel is assembled between the back cover and the bezel, and is exposed by an opening in the bezel, so the user can see the display images. Besides the surface of the display facing the user having a display panel, the display further includes bezel parts surrounding the display panel. If a light emitting element can be disposed on the bezel parts to display scene light, then the user can see the display images with better visual comfort.

SUMMARY OF THE INVENTION

The invention provides a display, wherein a bezel includes an electroluminescent light (EL) source layer to provide scene light.

The invention provides a bezel, suitable for a display and has an electroluminescent light source layer to provide scene light.

The invention provides a manufacturing method of a bezel, wherein the manufactured bezel is suitable for a display and has an electroluminescent light source layer to provide scene light.

The invention provides a display, suitable for a portable electronic device. The display includes a back cover, a bezel, and a display panel. The bezel includes a frame and an electroluminescent light source layer. The frame is assembled to the back cover and includes an opening The electroluminescent light source layer is attached to the frame, wherein the electroluminescent light source layer and the frame are formed by an in-mold forming (IMF) process and is then integrated with the back cover. The display panel is assembled between the back cover and the frame and is exposed by the opening.

The invention provides a bezel, suitable for a display of a portable electronic device; the display includes a display panel and a back cover. The bezel includes a frame and an electroluminescent light source layer. The frame is assembled to the back cover and has an opening, wherein the display panel is assembled between the back cover and the frame and is exposed by the opening The electroluminescent light (EL) source layer is attached to the frame, wherein the electroluminescent light source layer and the frame are integrated by an in-mold forming process.

In an embodiment of the invention, the bezel further includes at least one pattern printing layer, attached to the electroluminescent light source layer.

In an embodiment of the invention, a material of the frame is a transparent material.

In an embodiment of the invention, a material of the back cover is a transparent material.

In an embodiment of the invention, the electroluminescent light source layer is surrounding the opening.

The invention provides a manufacturing method of a bezel, the bezel is suitable for a display of a portable electronic device. First, a first mold and a second mold are provided. Next, a frame is provided, and is disposed between the first mold and the second mold. An electroluminescent light source layer is provided, and is disposed between the frame and the second mold. The electroluminescent light source layer is compressed on the frame by the first mold and the second mold.

In an embodiment of the invention, the method for manufacturing a bezel further includes an electroluminescent light source layer parent material. The electroluminescent light source layer parent material is cut to form the electroluminescent light source layer.

In an embodiment of the invention, the electroluminescent light source layer and the frame are integrated by an in-mold forming process.

Based on the above, the bezel of the invention includes the electroluminescent light source layer surrounding the opening, used to display scene light, allowing the user to see the display images with better visual comfort. Since the electroluminescent light source layer is flexible, it can undergo cutting or bending without affecting the luminescence performance and can achieve a uniform lighting effect without a light guide plate or other optical elements. Furthermore, the electroluminescent light source layer is a cold light source, and can avoid the display from overheating while displaying scene light. Also, the electroluminescent light source layer is a low power consumption light emitting element, and thus has a power saving advantage.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
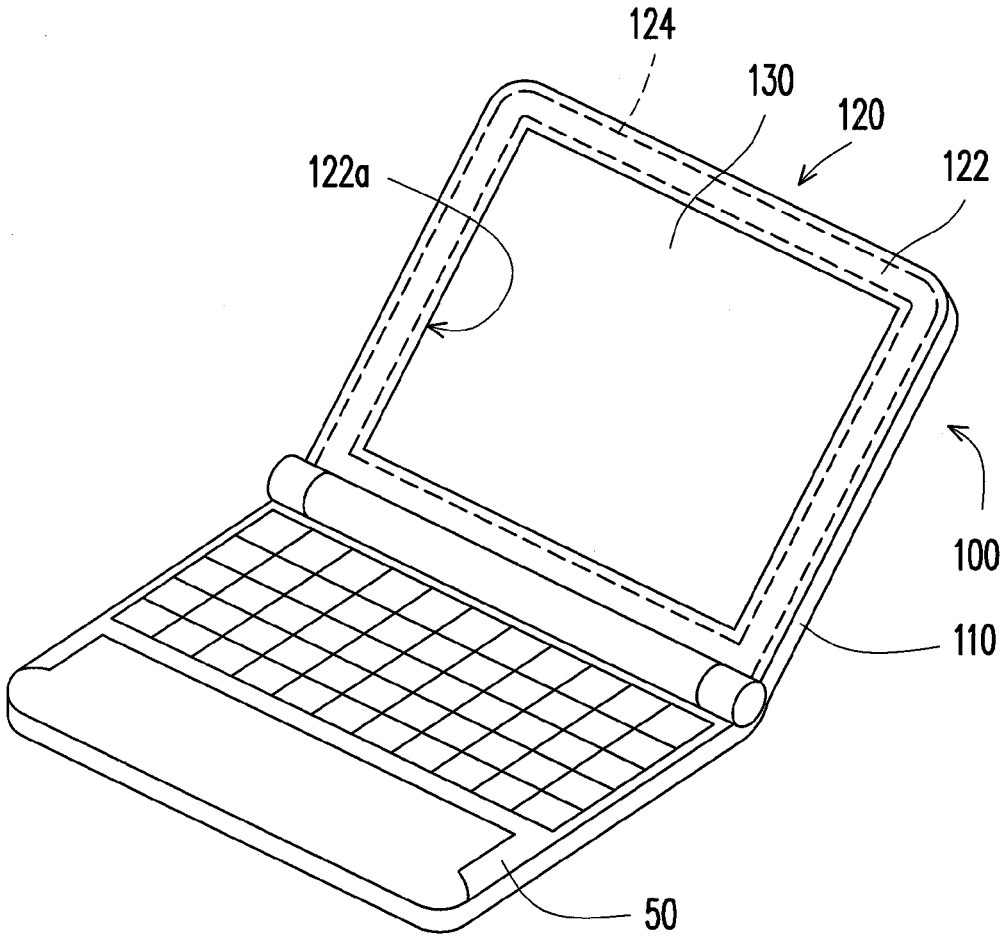
FIG. 1 and FIG. 2 are three-dimensional schematic views of a display according to an embodiment of the invention.
Figure 2:
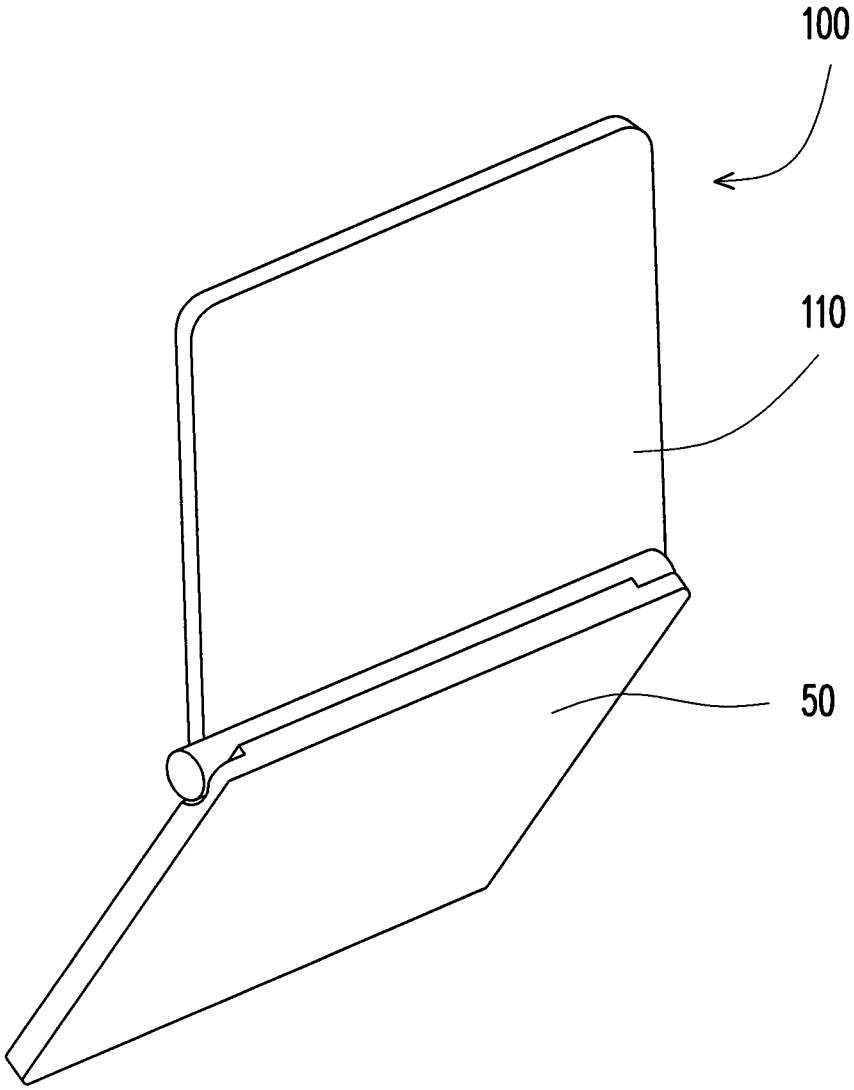
Figure 3:
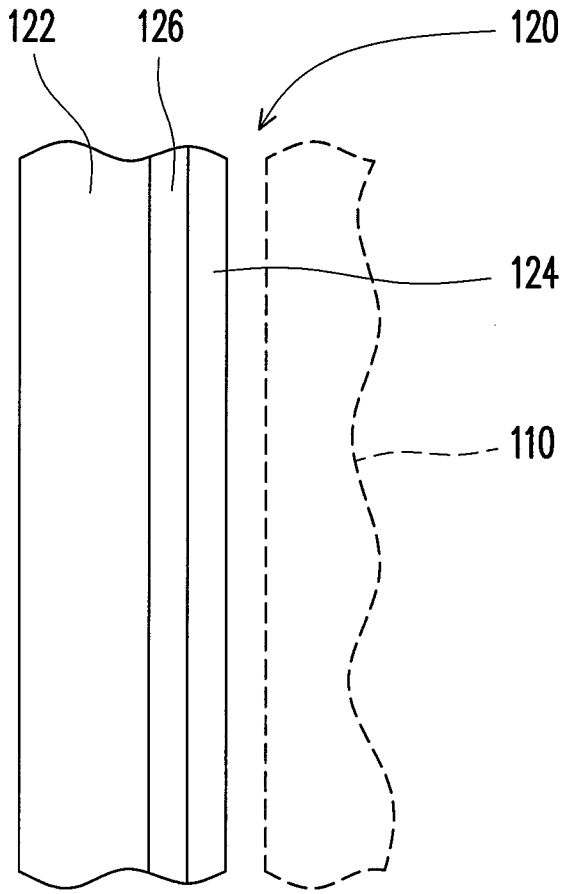
FIG. 3 is a partial schematic cross-sectional view of the bezel in FIG. 1.

FIG. 1 and FIG. 2 are three-dimensional schematic views of a display according to an embodiment of the invention. Please refer to FIG. 1 and FIG. 2. The display 100 of the embodiment is suitable to assemble on a main body 50 of a portable electronic device. The display 100 includes a back cover 110, a bezel 120, and a display panel 130. The portable electronic device is for example, a notebook computer. FIG. 3 is a partial schematic cross-sectional view of the bezel in FIG. 1. Please refer to FIG. 1 and FIG. 3. The bezel 120 includes a frame 122 and an electroluminescent light (EL) source layer 124. The frame 122 is assembled to the back cover 110 and includes an opening 122*a*. The electroluminescent light source layer 124 is attached to the frame 122 and surrounds the opening 122*a*. The display panel 130 is assembled between the back cover 110 and the frame 122 and is exposed by the opening 122*a*.

The electroluminescent light source layer 124 is electrically connected to the main body 50. The main body 50 is suitable to control the electroluminescent light source 124 to emit light, which is used to display scene light, letting the user see the displayed images with more visual comfort. Since the electroluminescent light source layer 124 is flexible, it can undergo cutting or bending without affecting the luminescence performance and can achieve a uniform lighting effect without a light guide plate or other optical elements. Furthermore, the electroluminescent light source layer 124 is a cold light source, and can avoid the display 100 from overheating while displaying scene light. Also, the electroluminescent light source layer 124 is a low power consumption light emitting element, and thus has a power saving advantage.

Please refer to FIG. 3. The bezel 120 of the embodiment further includes a pattern printing layer 126. The pattern printing layer 126 is attached to the electroluminescent light source layer 124, allowing the electroluminescent light source layer 124 to display scene light in harmony with the pattern printing layer 126, further improving the visual comfort of the user. In the embodiment, a material of the frame 122 can be selected as a transparent material, causing the electroluminescent light source layer 124 to emit light suitable to pass through the frame 122 and arrive to the outside. In addition, a material of the back cover 110 illustrated in FIG. 2 can be selected as a transparent material, causing the electroluminescent light source layer 124 to emit light suitable to pass through the back cover 110 and arrive to the outside, causing the display 100 to also display scene light from the back cover 110.

Figure 4:
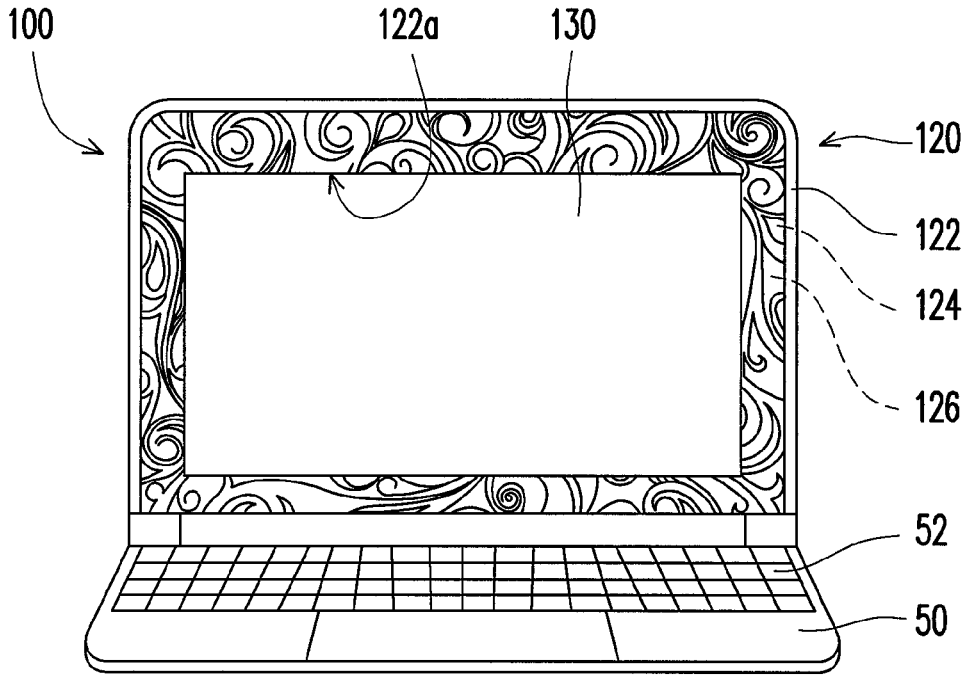
FIG. 4 is a schematic view of the electroluminescent light source layer in FIG. 1.

FIG. 4 is a schematic view of the electroluminescent light source layer in FIG. 1. Please refer to FIG. 4. In an example, when a user operates a notebook computer, the electroluminescent light source layer 124 can be controlled to emit light through pressing a key 52 on the main body 50, to display scene light in harmony with the pattern printing layer 126. In an example, the light emitted by the electroluminescent light source layer 124 can be controlled to flash off with a fading manner, in order to display scene light. In addition, music can also be played while displaying scene light, providing the user with visual and listening comfort. It should be noted that the invention does not limit the quantity of the pattern printing layer 126. In other embodiments, a plurality of pattern printing layers 126 may be disposed, allowing the electroluminescent light source layer 124 to emit more beautiful scene light in harmony with an assembly of the plurality of pattern printing layers 126.

Figure 5:
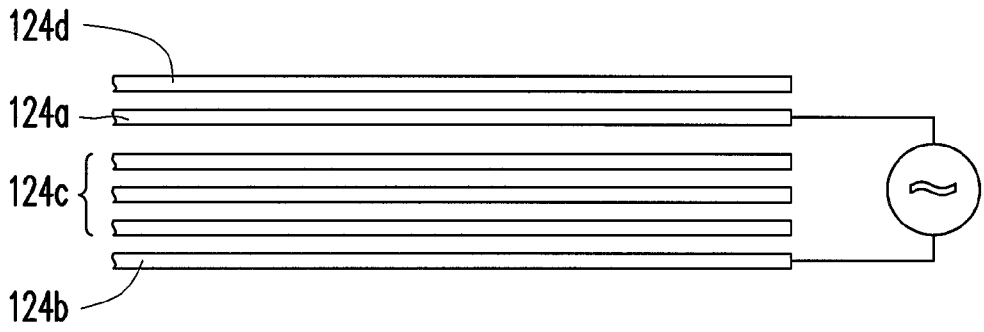
FIG. 5 is an exploded view of the electroluminescent light source layer in FIG. 1.

FIG. 5 is an exploded view of the electroluminescent light source layer in FIG. 1. Please refer to FIG. 5. In detail, the electroluminescent light source layer 124 is made up of an electrode layer 124*a*, an electrode layer 124*b*, a light emitting layer 124*c*, and a transparent layer 124*d*. The light emitting layer 124*c* is sandwiched between the electrode layer 124*a* and the electrode layer 124*b*. The transparent layer 124*d* covers the electrode layer 124*a*. The light emitted by the light emitting layer 124*c* is suitable to sequentially pass through the electrode layer 124*a* and the transparent layer 124*d* to arrive to the outside. The invention does not limit the method of disposing the pattern printing layer 126. For example, the transparent layer 124*d* in FIG. 5 can directly print a pattern, making it a pattern printing layer. In addition, the invention also does not limit the disposed location of the electroluminescent light source layer 124. Besides being disposed in the inner surface of the frame 122 shown in FIG. 1 and FIG. 3, in other embodiments, the electroluminescent light source layer 124 can be disposed on the outer surface of the frame 122, exposed to the display 100.

Figure 6A:
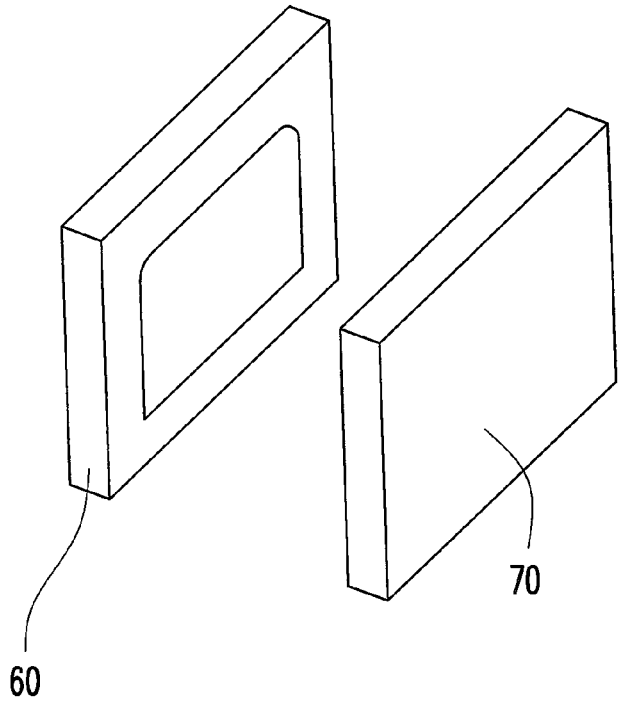
FIGS. 6A to 6D are flowcharts illustrating the manufacturing of the bezel in FIG. 1.
Figure 6B:
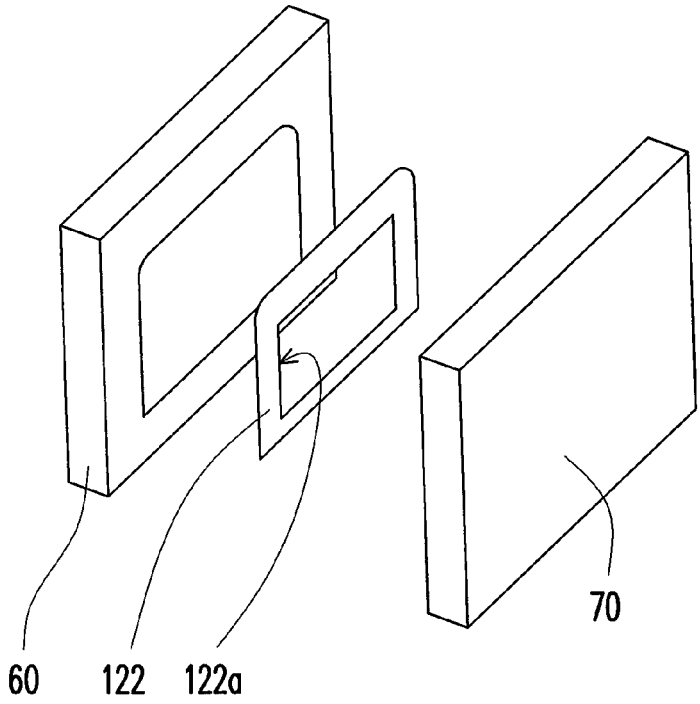
Figure 6C:
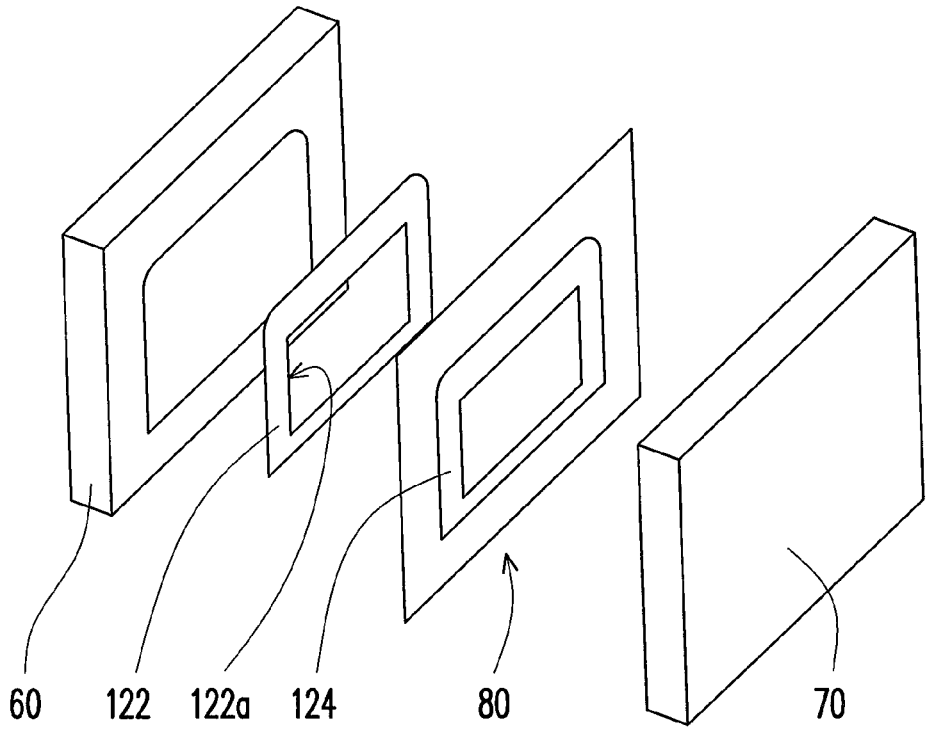
Figure 6D:
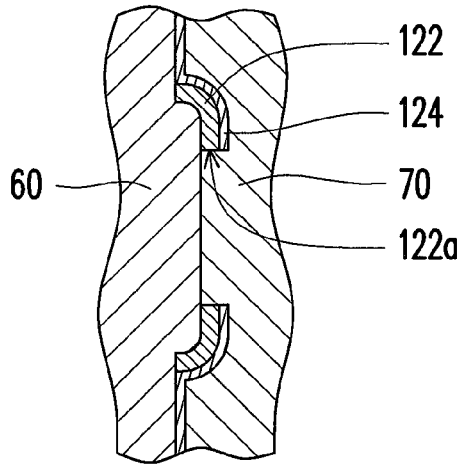

The bezel 120 of FIG. 1 is manufactured through, for example, an in-mold forming process, described through figures below. FIGS. 6A to 6D are flowcharts illustrating the manufacturing of the bezel in FIG. 1. Please refer to FIG. 6A. First, a first mold 60 and a second mold 70 are provided. Referring to FIG. 6B, next, the frame 122 is provided, and is disposed between the first mold 60 and the second mold 70. Please refer to FIG. 6C. The electroluminescent light source layer 124 is provided and disposed between the frame 122 and the second mold 70, which is for example, an electroluminescent light source layer parent material 80 provided between the frame 122 and the second mold 70, wherein the following steps cut the electroluminescent light source layer parent material 80 to obtain the electroluminescent light source layer 124. Please refer to FIG. 6D. The electroluminescent light source layer parent material 80 is compressed on the frame 122 by the first mold 60 and the second mold 70. Finally, the electroluminescent light source layer parent material 80 and the frame 122 compressed into a body is taken out from the first mold 60 and the second mold 70, and the electroluminescent light source layer parent material 80 is cut to form the electroluminescent light source layer 124, to obtain the bezel 120 in FIG. 1.

It should be noted that the invention does not limit the moment of cutting the electroluminescent light source layer parent material 80. In other embodiments, the electroluminescent light source layer parent material 80 can be cut to form the electroluminescent light source layer 124 before it is compressed on the frame 122. Then the electroluminescent light source layer 124 can be compressed on the frame 122.

Generally, the bezel of the invention includes the electroluminescent light source layer surrounding the opening, used to display scene light, allowing the user to see the display images with better visual comfort. Since the electroluminescent light source layer is flexible, and thus can undergo cutting or bending without affecting the luminescence performance and can achieve a uniform lighting effect without a light guide plate or other optical elements. Furthermore, the electroluminescent light source layer is a cold light source, and can avoid the display from overheating while displaying scene light. Also, the electroluminescent light source is a low power consumption light emitting element, and thus has a power saving advantage.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A display, suitable for a portable electronic device, the display comprising:

a back cover;

a bezel, comprising:

a frame, assembled to the back cover and having an opening; and an electroluminescent light source layer, attached to the frame, wherein the electroluminescent light source layer and the frame are formed by an in-mold forming process and then integrated with the back cover; and a display panel, assembled between the back cover and the frame and exposed by the opening.

2. The display as claimed in claim 1, wherein the bezel further comprises:

at least one pattern printing layer, attached to the electroluminescent light source layer.

3. The display as claimed in claim 1, wherein the material of the frame is a transparent material.

4. The display as claimed in claim 1, wherein the material of the back cover is a transparent material.

5. The display as claimed in claim 1, wherein the electroluminescent light source layer is surrounding the opening.

6. A bezel, suitable for a display of a portable electronic device, the display comprises a display panel and a back cover, the bezel comprising:

a frame, assembled to the back cover and having an opening, wherein the display panel is assembled between the back cover and the frame and exposed by the opening; and an electroluminescent light source layer, attached to the frame, wherein the electroluminescent light source layer and the frame are integrated by an in-mold forming process.

7. The bezel as claimed in claim 6, further comprising:

at least one pattern printing layer, attached to the electroluminescent light source layer.

8. The bezel as claimed in claim 6, wherein the material of the frame is a transparent material.

9. The bezel as claimed in claim 6, wherein the material of the back cover is a transparent material.

10. The bezel as claimed in claim 6, wherein the electroluminescent light source layer is surrounding the opening.

11. A method for manufacturing a bezel, the bezel is suitable for a display of an electronic device, the method comprising:

providing a first mold and a second mold;

providing a frame, and disposing the frame between the first mold and the second mold;

providing an electroluminescent light source layer, and disposing the electroluminescent light source layer between the frame and the second mold; and compressing the electroluminescent light source layer on the frame by the first mold and the second mold.

12. The method for manufacturing the bezel as claimed in claim 11, wherein the steps for providing the electroluminescent light source layer comprises:

providing an electroluminescent light source layer parent material; and cutting the electroluminescent light source layer parent material to form the electroluminescent light source layer.

13. The method for manufacturing the bezel as claimed in claim 11, wherein the electroluminescent light source layer and the frame are integrated by an in-mold forming process.

* * * * *